US008778861B2

(12) United States Patent
Shi et al.

(10) Patent No.: US 8,778,861 B2
(45) Date of Patent: Jul. 15, 2014

(54) LIQUID SOAPS WITH TRICLOCARBAN

(75) Inventors: Manying Shi, Guangzhou (CN); David Chang, Guangzhou (CN)

(73) Assignee: Colgate-Palmolive Company, New York, NY (US)

( * ) Notice: Subject to any disclaimer, the term of this patent is extended or adjusted under 35 U.S.C. 154(b) by 0 days.

(21) Appl. No.: 14/114,294

(22) PCT Filed: May 27, 2011

(86) PCT No.: PCT/CN2011/000905

§ 371 (c)(1), (2), (4) Date: Oct. 28, 2013

(87) PCT Pub. No.: WO2012/162854

PCT Pub. Date: Dec. 6, 2012

(65) Prior Publication Data

US 2014/0057824 A1 Feb. 27, 2014

(51) Int. Cl.

| | |
|---|---|
| ***C11D 1/94*** | (2006.01) |
| ***C11D 3/48*** | (2006.01) |
| ***C11D 10/04*** | (2006.01) |

(52) U.S. Cl.

USPC ..... 510/131; 510/130; 510/490; 510/138; 510/149; 510/152; 510/155; 510/156; 510/159; 510/382; 510/388; 510/389; 510/426; 510/427; 510/430

(58) Field of Classification Search

USPC ..... 510/130, 131, 138, 149, 152, 155, 156, 510/159, 382, 388, 389, 426, 427, 430, 490

See application file for complete search history.

(56) References Cited

U.S. PATENT DOCUMENTS

| | | | | |
|---|---|---|---|---|
| 4,975,218 | A | 12/1990 | Rosser | |
| 6,121,214 | A | 9/2000 | Exner et al. | |
| 2004/0121936 | A1 | 6/2004 | Harmalker | |
| 2006/0159639 | A1* | 7/2006 | Ogura et al. | 424/65 |
| 2007/0066499 | A1* | 3/2007 | Slavtcheff et al. | 510/130 |
| 2011/0039746 | A1* | 2/2011 | Hermanson et al. | 510/159 |

FOREIGN PATENT DOCUMENTS

| | | |
|---|---|---|
| EP | 1767186 | 3/2007 |
| GB | 2351979 | 1/2001 |
| JP | 2006-183030 | 7/2006 |

OTHER PUBLICATIONS

International Search Report and Written Opinion in International Application No. PCT/CN11/000905, mailed Mar. 8, 2012.
Lifebuoy Antibacterial Deep Clean Body Wash, 2009, Mintel GNPD 1081040.
Lifebuoy Bath Milk, 2009, Mintel GNPD 1127467.
Lifebuoy Bath Milk, 2009, Mintel GNPD 1188864.
Lifebuoy Cream Contra Bacterias Liquid Soap, 2010, Mintel GNPD 1374212.
Lifebuoy Deep Clean Bodywash, 2008, Mintel GNPD 892457.
Lifebuoy Deep Clean Bodywash, 2009, Mintel GNPD 1087464.
Lifebuoy Deepclean Body Wash, 2007, Mintel GNPD 810173.
Lifebuoy Deepclean Bodywash, 2008, Mintel GNPD 882156.
Lifebuoy Extra Protection Bath Liquid, 2007 Mintel GNPD 712275.
Lifebuoy Extra Protection Bath Liquid, 2008, Mintel GNPD 892847.
Lifebuoy Family Body Wash, 2005, Mintel GNPB 386375.
Lifebuoy Men Hydrating Body Wash, 2009, Mintel GNPD 1073295.
Lifebuoy Milk Bath Softener, 2008, Mintel GNPD 892921.
Lifebuoy Naturepure Body Wash, 2010, Mintel GNPD 1284084.
Lifebuoy Naturepure Deep Clean Body Wash, 2009, Mintel GNPD 1230298.
Lifebuoy Totalprotect Handwash, 2009, Mintel GNPD 1233988.
Snake Brand Aroma Lavender Hygienic Body Wash, 2008, Mintel GNPD 887328.
Tesco Propolis Anti-Bacterial Shower Cream, 2009, Mintel GNPD 1211339.

* cited by examiner

*Primary Examiner* — Charles Boyer
(74) *Attorney, Agent, or Firm* — Michael P. Morgan

(57) ABSTRACT

An aqueous and liquid cleansing composition comprises a fatty acid soap, a salt of a lauryl ether sulfate surfactant that is present in an amount that is at least 50% of the weight of the fatty acid soap, a betaine surfactant that is present in an amount that is at least 23% of the weight of the fatty acid soap, and at least 0.05% by weight of the composition of triclocarban. The lauryl ether sulfate and betaine surfactant in the specified amount in relation to the fatty acid soap amount keep the triclocarban from precipitating out of the composition.

14 Claims, No Drawings

LIQUID SOAPS WITH TRICLOCARBAN

FIELD OF THE INVENTION

Soap mix cleansing composition containing triclocarban.

BACKGROUND OF THE INVENTION

Soap mix cleansing compositions are aqueous compositions that contain fatty acid soap and synthetic surfactants in combination. Soap mix compositions are typically used by consumers that want a squeaky clean skin feel similar to that provided by bar soap. Shower gels that contain all synthetic surfactants leave the skin feeling smooth. The squeaky clean feel is desired by consumers in Asia and Latin America.

Consumers have a desire for a cleansing composition to provide an antibacterial benefit. Antibacterial agents are typically added to the cleansing composition. Triclocarban (3,4,4'-trichlorocarbanilide or 3-(4-Chlorophenyl)-1-(3,4-dichlorophenyl)urea or TCC) is a common antibacterial agent that is used in bar soaps. Triclocarban, however, is not stable in soap mix compositions in that it precipitates out after a short period of time when included in amounts that are greater than 0.01 weight % of the composition. At this low level, triclocarban is used in conjunction with another antibacterial agent. It would be desirable for a soap mix formula to stably retain triclocarban in greater amounts to deliver an antibacterial benefit.

BRIEF SUMMARY OF THE INVENTION

An aqueous, liquid cleansing composition comprising a fatty acid soap, a salt of a lauryl ether sulfate surfactant that is present in an amount that is at least 50% of the weight of the fatty acid soap, a betaine surfactant that is present in an amount that is at least 23% of the weight of the fatty acid soap, and at least 0.05% by weight of the composition of triclocarban.

Also, method of solubilizing triclocarban in a soap mix composition comprising mixing the fatty acid soap, the lauryl ether sulfate surfactant, the betaine surfactant, the triclocarban, and water of the composition.

Further areas of applicability of the present invention will become apparent from the detailed description provided hereinafter. It should be understood that the detailed description and specific examples, while indicating the preferred embodiment of the invention, are intended for purposes of illustration only and are not intended to limit the scope of the invention.

DETAILED DESCRIPTION OF THE INVENTION

The following description of the preferred embodiment(s) is merely exemplary in nature and is in no way intended to limit the invention, its application, or uses.

The fatty acid soap can be any of the neutralized fatty acids. Typical fatty acids used for soaps include, myristic acid, lauric acid, palmitic acid, stearic acids, and other fatty acids. Sources of fatty acids include coconut oil, palm oil, palm kernel oil, tallow, avocado, canola, corn, cottonseed, olive, hi-oleic sunflower, mid-oleic sunflower, sunflower, palm stearin, palm kernel olein, safflower, and babassu oils. The fatty acids can be neutralized with any base to form a soap. Typical bases include, but are not limited to, sodium hydroxide, potassium hydroxide, and triethanolamine. In one embodiment, the soap is a potassium soap. In certain embodiments, the fatty acid soap is present in the composition in an amount of at least 8 weight %. In certain embodiments, the fatty acid soap is present in the composition in an amount up to 30 weight %. In other embodiments, the amount is 8 to 30 weight %, 10 to 30 weight %, 10 to 20 weight %, or at least 10, 11, 12, 13, 14, 15, 16, 17, 18, 19, or 20 up to 30 weight %.

In one embodiment, the soap is a soap of lauric acid, myristic acid, and optionally a mixture of $C_{12-18}$ fatty acids. In certain embodiments, the amount of lauric acid soap is present in an amount that is greater than any other fatty acid soap, and in other embodiments, lauric acid soap is at least 50% of the total weight of all fatty acid soaps. In other embodiments, the lauric acid soap is 1.3 to 1.7, 1.4 to 1.6, or about 1.5 times the weight of myristic acid soap. Having shorter chain fatty acids increases the solubility of TCC. In another embodiment, these soaps are potassium soaps.

The soap can be made in situ in the composition by mixing fatty acids with the neutralizing agent. In certain embodiments, the molar amount of fatty acids is greater than the molar amount of neutralizing agent such that fatty acid remains in the composition. In certain embodiments, the total amount of soap includes the neutralized fatty acids and free fatty acids. In certain embodiments, the amount of free fatty acids is up to 20 weight % of the total amount of soap in the composition.

The composition contains triclocarban as an antibacterial agent. The amount of triclocarban is at least 0.05 weight % of the composition. In another embodiment, the amount is at least 0.1 weight %, at least 0.15 weight %, or at least 0.17 weight %.

To solubilize the TCC in a soap mix composition, the composition contains a salt of a lauryl ether sulfate surfactant and a betaine surfactant. The lauryl ether sulfate surfactant is present in an amount that is at least 50% of the weight of the fatty acid soap, and the betaine surfactant is present in an amount that is at least 23%, optionally 24% or 25%, of the weight of the fatty acid soap. The combination of these two surfactants in these weight ratios will keep TCC solubilized in the composition when the TCC is present in an amount up to 1.7% by weight of the fatty acid soap. In other embodiments, the amount of lauryl ether sulfate surfactant is 50 to 70% of the weight of the fatty acid soap. In other embodiments, the betaine surfactant is 23 to 36%, 24 to 36%, or 25 to 36% of the weight of the fatty acid soap.

The salt of a lauryl ether sulfate surfactant can be any of the typical salts for surfactants. Examples include sodium and ammonium salts. In one embodiment, the surfactant is a sodium lauryl ether (laureth) sulfate. In one embodiment, the lauryl ether sulfate has an average of about 2 ethylene oxide groups per mole.

The betaine surfactant can be any betaine surfactant. Examples of betaine surfactant include, but are not limited to, coco dimethyl carboxymethyl betaine, lauryl dimethyl carboxy-methyl betaine, lauryl dimethyl alpha-carboxyethyl betaine, cetyl dimethyl carboxymethyl betaine, lauryl bis-(2-hydroxyethyl)carboxy methyl betaine, stearyl bis-(2-hydroxypropyl)carboxymethyl betaine, oleyl dimethyl gamma-carboxypropyl betaine, and lauryl bis-(2-hydroxypropyl)alpha-carboxyethyl betaine, sulfobetaines such as coco dimethyl sulfopropyl betaine, stearyl dimethyl sulfopropyl betaine, amido betaines, amidosulfobetaines and the like. In one embodiment, the betaine surfactant is cocamidopropyl betaine.

Water is present in the composition in an amount that is sufficient to form a liquid composition. In certain embodiments, the amount of water is at least 65 weight %, or 65 to 90 weight %. In other embodiments the amount of water is 75 to 85 weight %.

By solubilized, it is meant that the TCC will remain in the composition when aged at 40° C. for at least 3 months. The composition is maintained at 40° C.+/−2° C. at 75% relative humidity+/−5% relative humidity for 3 months. In certain embodiments, the amount of TCC that remains in the composition is at least 90, 91, 92, 93, 94, 95, 96, 97, 98, 99, 99.9% by weight of the TCC. In one embodiment, the amount of TCC that remains solubilized is 100%.

The pH of the composition is greater than 7 so that the composition is basic to keep the fatty acid soap in soap form. If the pH becomes acidic, the fatty acid will revert to acid form. In certain embodiments, the pH is 8.9 to 9.5.

In one embodiment, the composition comprises at least 10 weight % of the potassium fatty acid soap, at least 5.6% by weight of the composition of the salt of a lauryl ether sulfate surfactant, at least 2.5% by weight of the composition of the betaine surfactant, and at least 0.15% by weight of the composition of triclocarban. In another embodiment, the composition comprises at least 10 weight % of the potassium fatty acid soap, at least 5.6% by weight of the composition of sodium lauryl ether sulfate surfactant, at least 2.5% by weight of the composition of cocamidopropyl betaine surfactant, and at least 0.15% by weight of the composition of triclocarban. In another embodiment, the composition comprises at least 15 weight % of the potassium fatty acid soap, at least 7.7% by weight of the composition of the salt of a lauryl ether sulfate surfactant, at least 3.6% by weight of the composition of the betaine surfactant, and at least 0.15% by weight of the composition of triclocarban. In another embodiment, the composition comprises at least 15 weight % of the potassium fatty acid soap, at least 7.7% by weight of the composition of sodium lauryl ether sulfate surfactant, at least 3.6% by weight of the composition of cocamidopropyl betaine surfactant, and at least 0.15% by weight of the composition of triclocarban.

EXAMPLES

Example 1

The following comparative, prophetic, and inventive compositions (A to E) were prepared by mixing the fatty acid soap, the sodium lauryl ether sulfate surfactant, the cocamidopropyl betaine surfactant, and the TCC. The stability of the TCC after aging at 40° C. for 3 months was evaluated. The results are in the table below. In the comparative examples when only one of the surfactants is present or when one or both of the surfactants are present below the required amount, the TCC precipitates out.

| Weight % | C1 | C2 | C3 | C4 | C5 | Prophetic1 | Prophetic2 | A | B | C | D | E |
|---|---|---|---|---|---|---|---|---|---|---|---|---|
| Potassium Soap | 10% | 10% | 10% | 10% | 10% | 17.2% | 18.3% | 10% | 10% | 10% | 10% | 10% |
| Cocamidopropyl Betaine | 2.9% | 0% | 0 | 2.9% | 1.2% | 0.76% | 0.78% | 2.9% | 2.9% | 2.4% | 2.7% | 2.9% |
| Sodium lauryl ether sulfate | 0 | 5.6% | 6.4% | 2.8% | 5.6% | 2.23% | 2.05% | 5.6% | 6.1% | 5.6% | 5.6% | 6.4% |
| TCC | 0.15% | 0.15% | 0.15% | 0.15% | 0.15% | 0.15% | 0.15% | 0.15% | 0.15% | 0.15% | 0.15% | 0.15% |
| Water and minors | Q.S. | Q.S. | Q.S. | Q.S. | Q.S. | Q.S. | Q.S. | Q.S. | Q.S. | Q.S. | Q.S. | Q.S. |
| Aging Result | TCC precipitated | TCC precipitated | TCC precipitated | TCC precipitated | TCC precipitated | Expected to fail | Expected to fail | Pass 3 months | Pass 3 months | Pass 3 months | Pass 3 months | Pass 3 months |

As used throughout, ranges are used as shorthand for describing each and every value that is within the range. Any value within the range can be selected as the terminus of the range. In addition, all references cited herein are hereby incorporated by referenced in their entireties. In the event of a conflict in a definition in the present disclosure and that of a cited reference, the present disclosure controls.

Unless otherwise specified, all percentages and amounts expressed herein and elsewhere in the specification should be understood to refer to percentages by weight. The amounts given are based on the active weight of the material.

What is claimed is:

1. An aqueous, liquid cleansing composition comprising
(a) at least 10 weight % fatty acid soap,
(b) a salt of a lauryl ether sulfate surfactant that is present in an amount that is at least 50% of the weight of the fatty acid soap,
(c) a betaine surfactant that is present in an amount that is at least 23% of the weight of the fatty acid soap, and
(d) at least 0.05% by weight of the composition of triclocarban.

2. The cleansing composition of claim 1, wherein the triclocarban is present in an amount of at least 0.1 weight % of the composition.

3. The cleansing composition of claim 1, comprising
(a) at least 10 weight % of the fatty acid soap,
(b) at least 5.6% by weight of the composition of the salt of a lauryl ether sulfate surfactant,
(c) at least 2.5% by weight of the composition of the betaine surfactant, and
(d) at least 0.15% by weight of the composition of triclocarban.

4. The cleansing composition claim 1, comprising
(a) at least 10 weight % of the fatty acid soap,
(b) at least 5.6% by weight of the composition of sodium lauryl ether sulfate surfactant,
(c) at least 2.5% by weight of the composition of cocamidopropyl betaine surfactant, and
(d) at least 0.15% by weight of the composition of triclocarban.

5. The cleansing composition of claim 1 comprising
(a) at least 15 weight % of the fatty acid soap,
(b) at least 7.7% by weight of the composition of the salt of a lauryl ether sulfate surfactant,
(c) at least 3.6% by weight of the composition of the betaine surfactant, and
(d) at least 0.15% by weight of the composition of triclocarban.

6. The cleansing composition of claim 5 comprising
(a) at least 15 weight % of the fatty acid soap,
(b) at least 7.7% by weight of the composition of sodium lauryl ether sulfate surfactant,
(c) at least 3.6% by weight of the composition of cocamidopropyl betaine surfactant, and
(d) at least 0.15% by weight of the composition of triclocarban.

7. The cleansing composition of claim 1, wherein the lauryl ether sulfate surfactant is present at 50 to 70% of the weight of the fatty acid soap.

8. The cleansing composition of claim 1, wherein the betaine surfactant is present at 23 to 36% of the weight of the fatty acid soap.

9. The cleansing composition of claim 1, wherein the fatty acid soap is a mixture of lauric acid soap and myristic acid soap.

10. The cleansing composition of claim 9, wherein the amount of lauric acid soap is 1.3 to 1.7 times the weight of myristic acid soap.

11. The cleansing composition of claim 1, wherein the fatty acid soap is a potassium fatty acid soap.

12. The cleansing composition of claim 1, wherein the lauryl ether sulfate surfactant has an average of about 2 ethylene oxide groups per mole.

13. The cleansing composition of claim 1, wherein the triclocarban remains stable in the composition after aging at 40° C. for 3 months.

14. A method of solubilizing triclocarban in a soap mix composition comprising mixing the fatty acid soap, the lauryl ether sulfate surfactant, the betaine surfactant, the triclocarban, and water of the composition of claim 1.

* * * * *